US010946547B2

(12) United States Patent
Hu et al.

(10) Patent No.: US 10,946,547 B2
(45) Date of Patent: Mar. 16, 2021

(54) ELECTRIC STRIKING DEVICE

(71) Applicant: APEX MFG. CO., LTD., Taichung (TW)

(72) Inventors: Chih-Wei Hu, Taichung (TW); Jing-Li Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 126 days.

(21) Appl. No.: 16/207,950

(22) Filed: Dec. 3, 2018

(65) Prior Publication Data

US 2020/0171694 A1 Jun. 4, 2020

(51) Int. Cl.

| | |
|---|---|
| ***B27F 7/38*** | (2006.01) |
| ***B25C 5/02*** | (2006.01) |
| ***B27F 7/36*** | (2006.01) |
| ***B27F 7/21*** | (2006.01) |

(52) U.S. Cl.

CPC ..... *B27F 7/38* (2013.01); *B25C 5/0228* (2013.01); *B27F 7/21* (2013.01); *B27F 7/36* (2013.01)

(58) Field of Classification Search

CPC . B25C 5/0228; B25C 5/15; B27F 7/21; B27F 7/36; B27F 7/37

See application file for complete search history.

(56) References Cited

U.S. PATENT DOCUMENTS 3,625,408 A * 12/1971 Amakawa ..... B25C 5/0228 227/131
3,666,157 A * 5/1972 Kawai ..... B25C 5/0228 227/131
3,786,978 A * 1/1974 Manganaro ..... B25C 1/06 227/8
3,950,721 A * 4/1976 Manganaro ..... B25C 5/15 335/278
4,033,500 A * 7/1977 Manganaro ..... B25C 1/06 227/131
4,183,453 A * 1/1980 Barrett ..... B25C 1/06 227/120
4,199,095 A * 4/1980 Yamanoi ..... B25C 5/1679 227/120
4,230,249 A * 10/1980 Nasiatka ..... B25C 5/06 173/202
4,491,262 A * 1/1985 Ewig ..... B25C 5/15 227/110
4,508,329 A * 4/1985 Hubler ..... B27F 7/38 227/120
4,511,074 A * 4/1985 Kille ..... B25C 1/06 227/109
4,558,391 A * 12/1985 Ward ..... B25C 5/15 227/131

(Continued)

*Primary Examiner* — Robert F Long

*Assistant Examiner* — Eduardo R Ferrero

(74) *Attorney, Agent, or Firm* — Muncy, Geissler, Olds & Lowe, P.C.

(57) ABSTRACT

An electric striking device is provided, including a main body and a striking unit. The main body includes an interior space and an outlet opening; the striking unit is disposed in the interior space, the striking unit includes an electromagnetic device, a driving member, a steering mechanism and an impacting member, the electromagnetic device drives the driving member to move along a direction perpendicular to an open direction of the outlet opening and further drive the impacting member to move along the open direction of the outlet opening.

7 Claims, 8 Drawing Sheets

(56) References Cited

U.S. PATENT DOCUMENTS 4,611,742 A * 9/1986 Rieker ..... B25C 5/15 173/121
4,623,082 A * 11/1986 Kurosawa ..... B27F 7/38 206/338
4,724,992 A * 2/1988 Ohmori ..... B25C 1/005 227/132
4,807,793 A * 2/1989 Ghibely ..... B25C 5/15 227/131
4,811,885 A * 3/1989 Lai ..... B25C 5/15 227/131
5,413,266 A * 5/1995 Jairam ..... B25C 5/0228 227/129
5,427,296 A * 6/1995 Chen ..... B25C 5/0228 227/131
5,460,313 A * 10/1995 Magnusson ..... B27F 7/36 227/131
5,460,314 A * 10/1995 Udagawa ..... B27F 7/19 227/131
5,605,268 A * 2/1997 Hayashi ..... B25C 5/15 227/131
5,806,750 A * 9/1998 Yamanushi ..... B27F 7/36 227/131
5,818,186 A * 10/1998 Camino ..... B27F 7/36 318/434
6,981,627 B2 * 1/2006 Tsai ..... B25C 5/0228 227/154
7,604,149 B2 * 10/2009 Tsai ..... B25C 5/11 227/132
7,770,771 B2 * 8/2010 Tsai ..... B25C 5/06 227/107
9,643,306 B2 * 5/2017 Largo ..... B25C 5/15
2001/0026361 A1 * 10/2001 Yamaguchi ..... B27F 7/36 355/133
2002/0134811 A1 * 9/2002 Napier ..... B24B 23/04 227/131
2003/0160083 A1 * 8/2003 Yu ..... B27F 7/21 227/76
2004/0155743 A1 * 8/2004 Sako ..... B25C 5/15 335/220
2005/0082334 A1 * 4/2005 Hu ..... B25C 1/06 227/131
2007/0095876 A1 * 5/2007 Oda ..... B25C 1/06 227/131
2012/0286018 A1 * 11/2012 Wang ..... B25C 5/11 227/139
2013/0228605 A1 * 9/2013 Wang ..... B25C 5/11 227/8
2013/0240594 A1 * 9/2013 Scabin ..... B25C 5/0207 227/108
2014/0027489 A1 * 1/2014 Marks ..... B25C 5/15 227/139
2015/0273645 A1 * 10/2015 Steurer ..... B21J 15/105 173/1
2018/0001455 A1 * 1/2018 Meyer ..... B25C 1/06

* cited by examiner

ELECTRIC STRIKING DEVICE

BACKGROUND OF THE INVENTION

Field of the Invention

The present invention relates to a striking device, and more particularly to an electric striking device.

Description of the Prior Art

Striking devices, such as staplers or nailing machines, are often used to nail and connect different objects, and since it is easy to operate the striking device, and the work can be quickly done, the striking device is widely popular among workers. In order to meet different needs of workers, the industry often make improvements to the structure of the striking device, for example but not limited thereto, improving an effort-saving mechanism, improving a capacity of a nail magazine, improving a striking mechanism or improving different driving methods (electric, pneumatic and manual).

However, regarding the striking device which is electromagnetically driven, moving directions of a driving rod and a striking member are the same as a magnetic orientation, so the whole structure has a height which is too high and wastes too much space. To better strike a nail out, the striking device which is electric has a great volume, so it is easy to make louder noises, and it is hard to the worker to fetch, operate and store.

The present invention has arisen to mitigate and/or obviate the afore-described disadvantages.

SUMMARY OF THE INVENTION

The major object of the present invention is to provide an electric striking device in which a structure of a striking unit is largely changed to effectively decrease an overall volume and greatly lower volume of noises, so it is easy for a user to use, carry around and store.

To achieve the above and other objects, an electric striking device is provided, including a main body and a striking unit. The main body includes an interior space and an outlet opening; the striking unit is disposed in the interior space, the striking unit includes an electromagnetic device, a driving member, a steering mechanism and an impacting member, the electromagnetic device is actuated by electricity to produce a magnetism to drive the driving member to move along a direction lateral to an open direction of the outlet opening, the impacting member is on the open direction of the outlet opening and movable along the open direction of the outlet opening, and the driving member and the impacting member are respectively connected to the steering mechanism.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
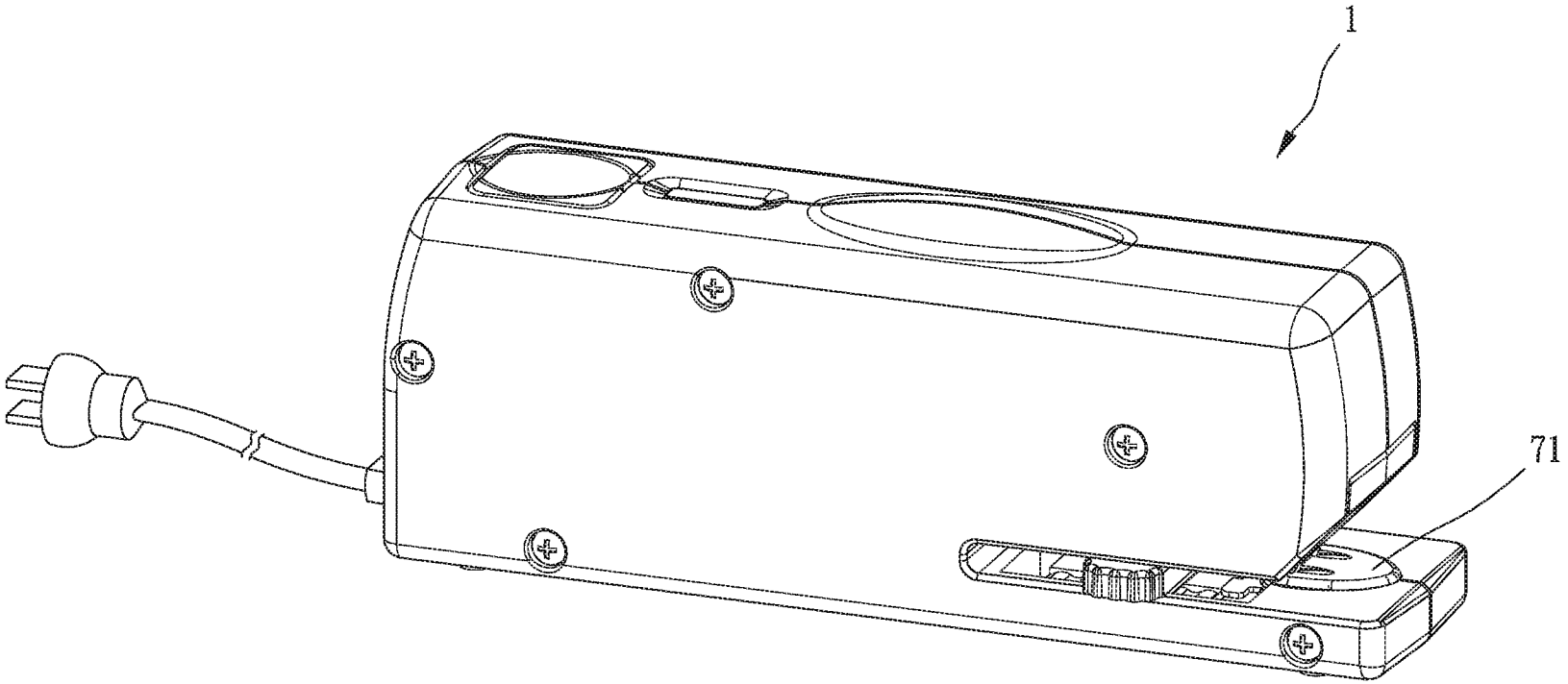
FIG. 1 is a stereogram of a first embodiment of the present invention.
Figure 2:
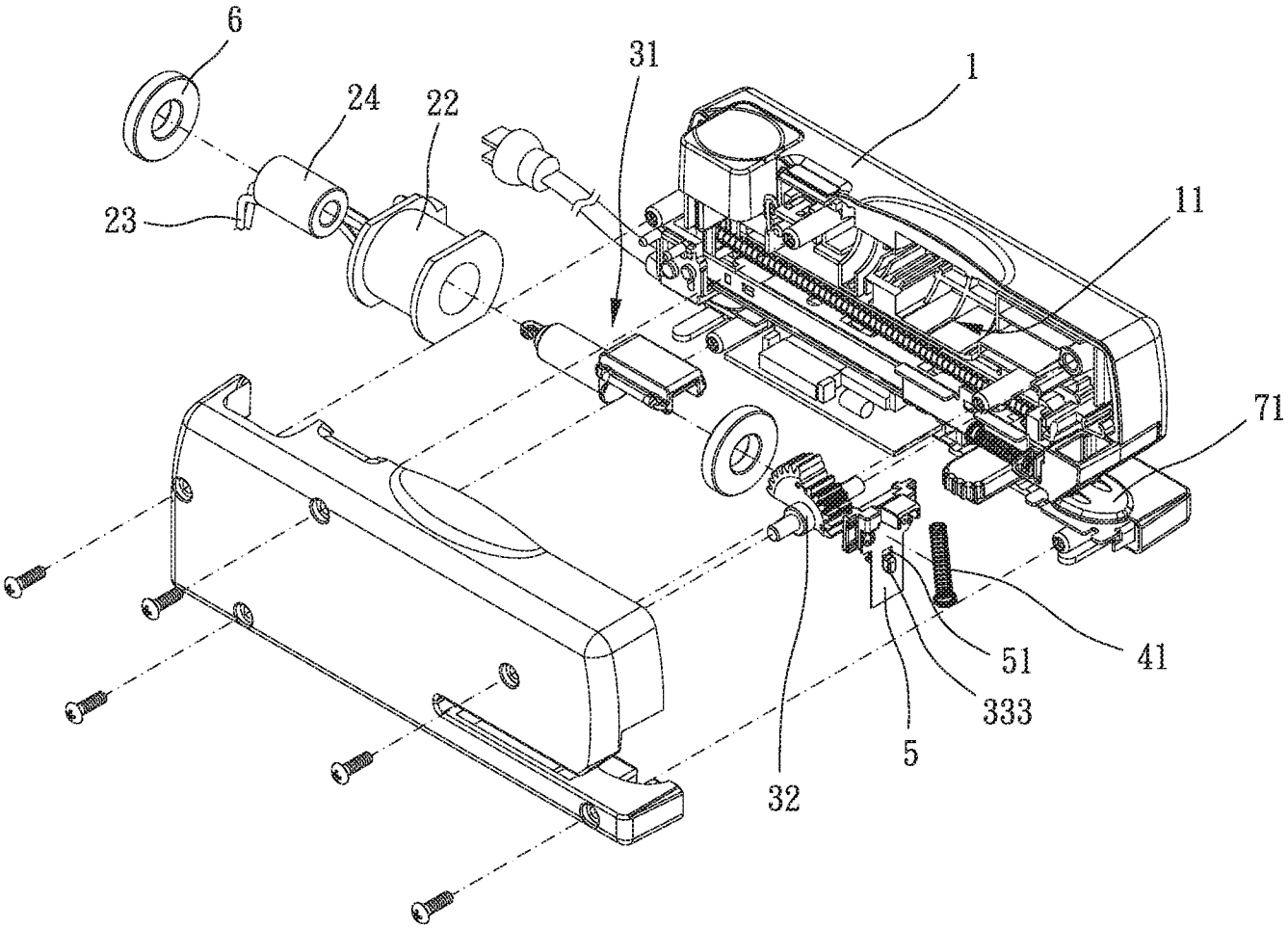
FIG. 2 is a breakdown view of FIG. 1.
Figure 3:
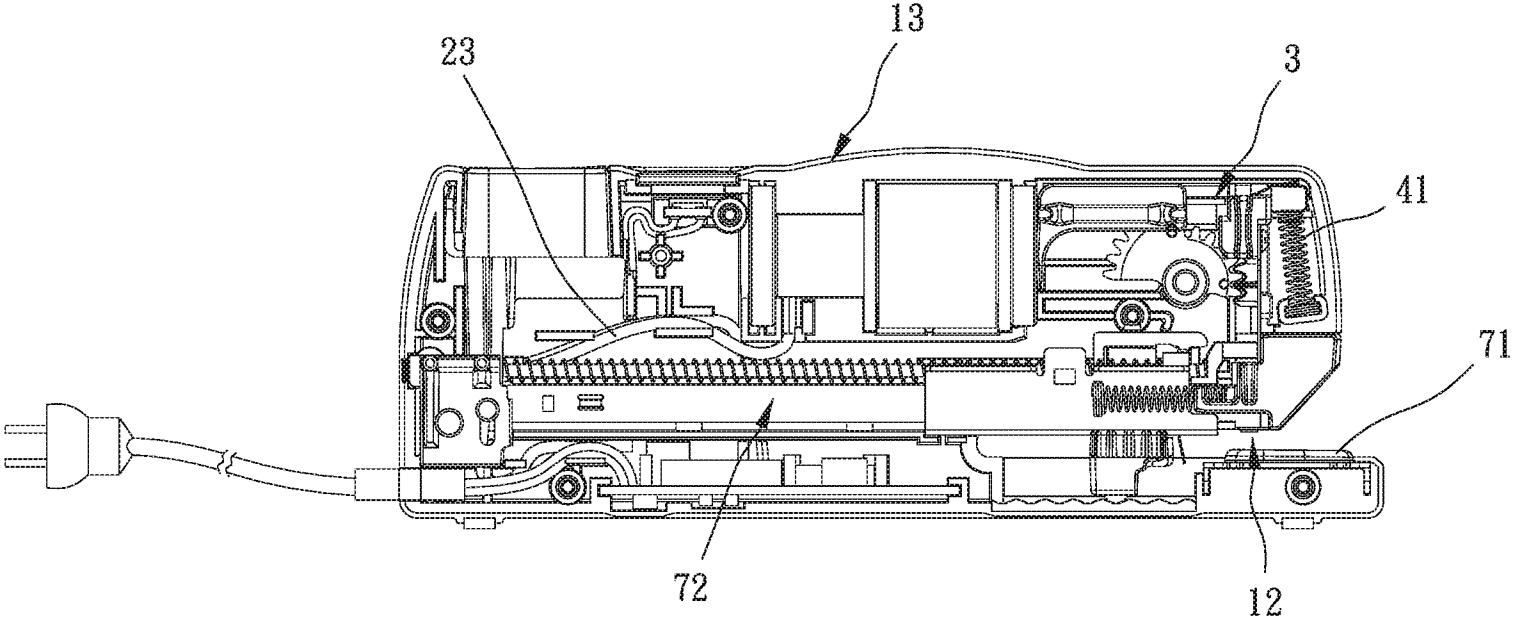
FIG. 3 is an interior top view of FIG. 1.
Figure 4:
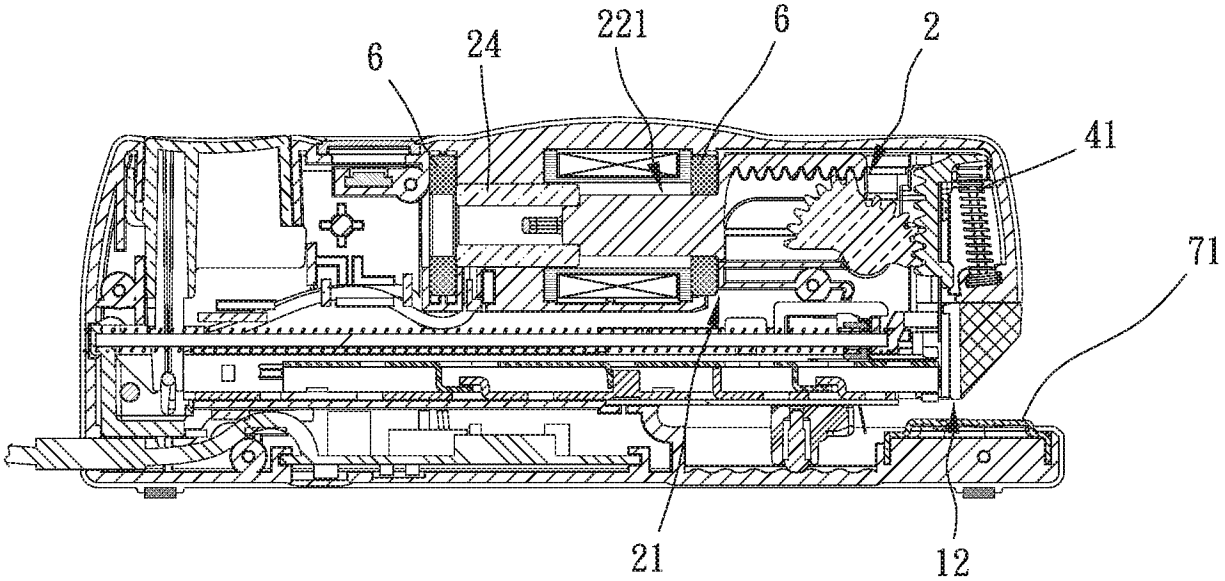
FIG. 4 is a cross-sectional view of FIG. 1.
Figure 5:
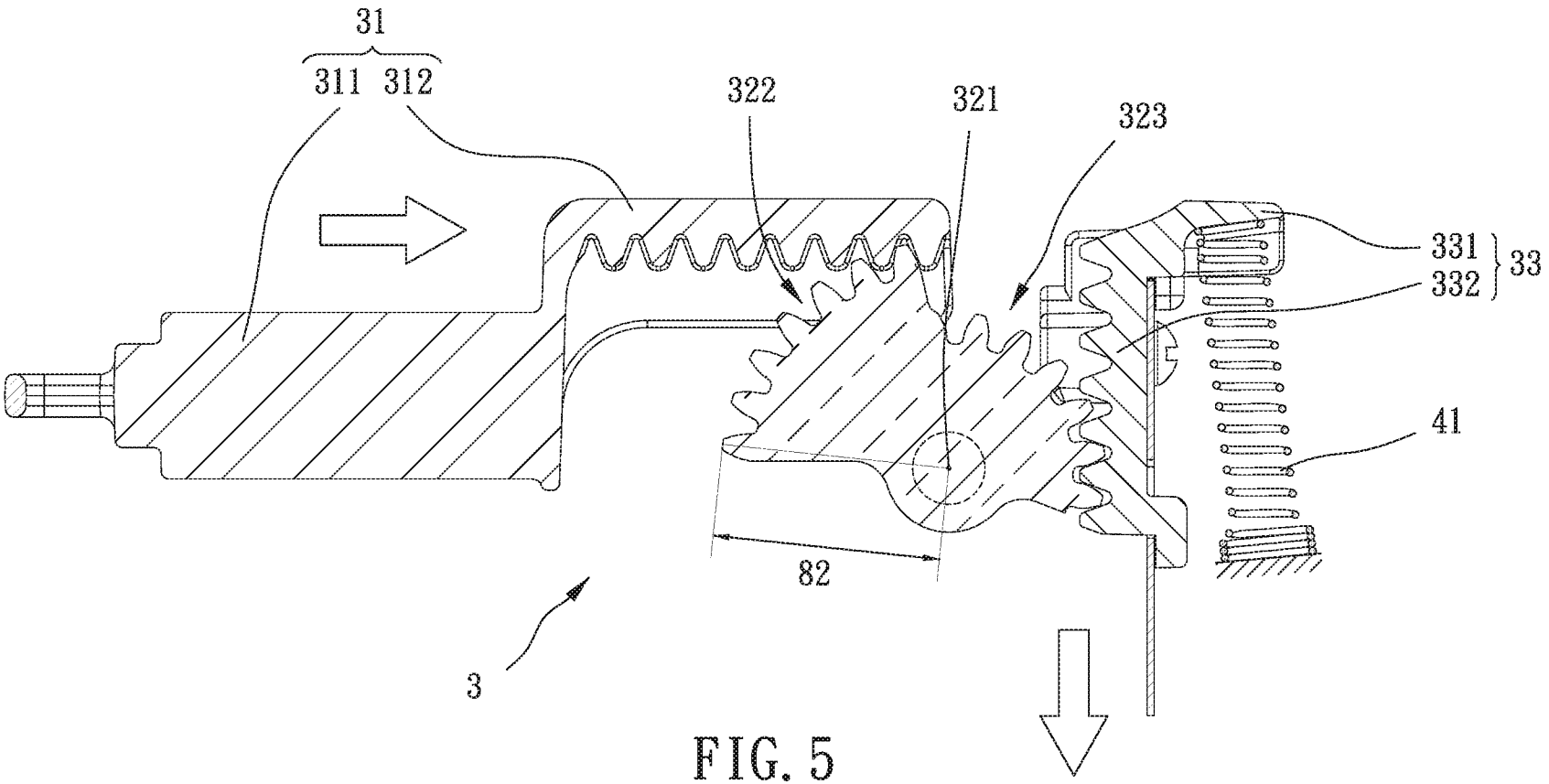
FIGS. 5 and 6 are drawings showing a steering mechanism of the first embodiment of the present invention in operation.
Figure 6:
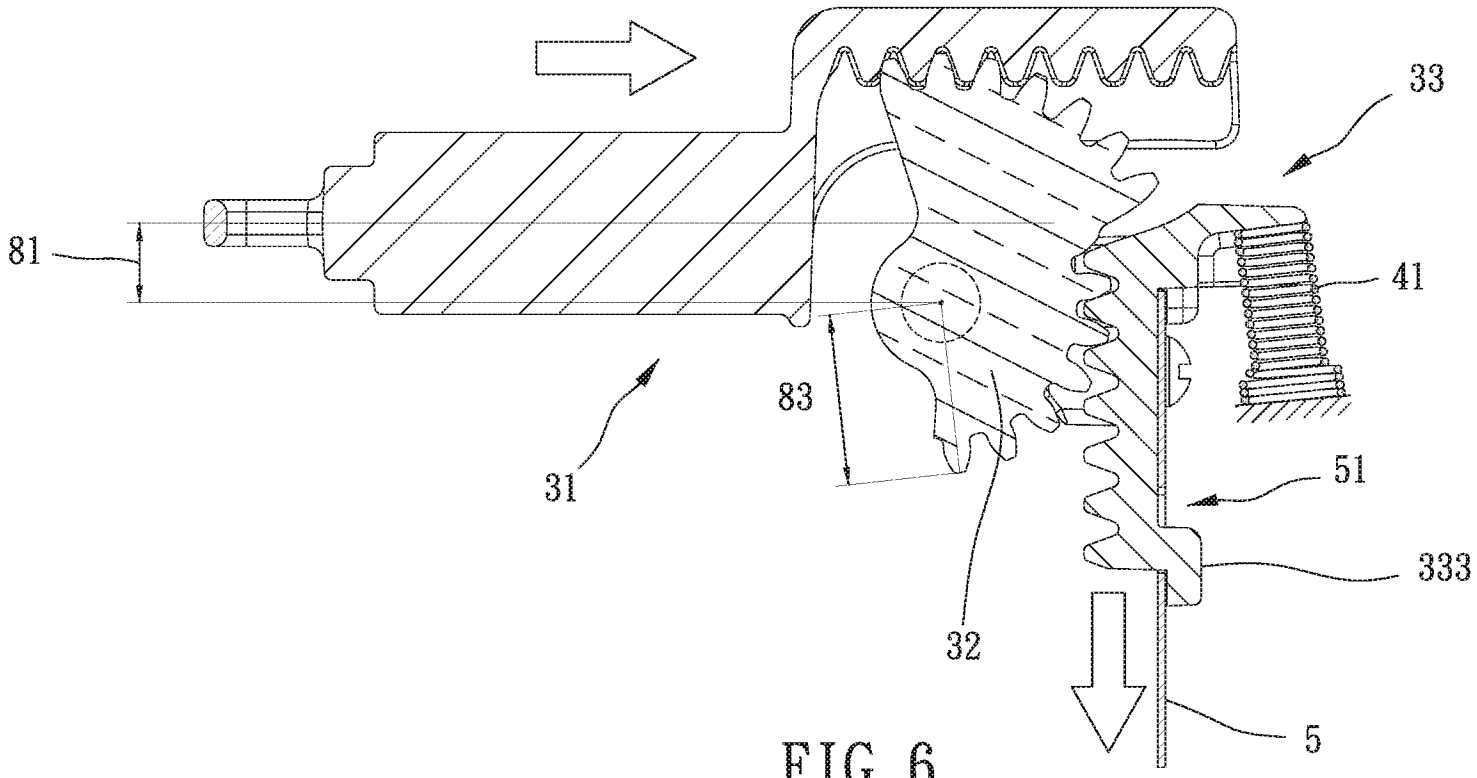

The present invention will be clearer from the following description when viewed together with the accompanying drawings, which show, for purpose of illustrations only, the preferred embodiment in accordance with the present invention.

Please refer to FIGS. 1 to 6 for a first embodiment of the present invention. An electric striking device includes a main body 1 and a striking unit 2.

The main body 1 includes an interior space 11 and an outlet opening 12. The striking unit 2 is disposed in the interior space 11, the striking unit 2 includes an electromagnetic device 21, a driving member 24, a steering mechanism 3 and an impacting member 5, the electromagnetic device 21 is actuated by electricity to produce a magnetism to drive the driving member 24 to move along a direction lateral to an open direction of the outlet opening 12; that is, a magnetic orientation produced by the electromagnetic device 21 is lateral to the open direction of the outlet opening 12, the impacting member 5 is on the open direction of the outlet opening 12 and movable along the open direction of the outlet opening 12, and the driving member 24 and the impacting member 5 are respectively connected to the steering mechanism 3.

When the driving member 24 is arranged to move along the direction lateral to the open direction of the outlet opening 12, the driving member 24 can use a space of an extension arm 13 which already exists in the main body 1 to move, so a part of the main body 1 at the outlet opening 12 does not need to expand to produce a space for the driving member 24 to move therein, and through this design, the electric striking device can have a compact volume for a user to store, fetch and carry around. In addition, the compactness of the overall volume can effectively decrease the speaker effect so that volume of noises produced during operation can be largely lowered to prevent people around from being disturbed.

Specifically, the electromagnetic device 21 includes an electromagnetic coil 22 and a wire 23, the driving member 24 is an iron core, the electromagnetic coil 22 defines an electromagnetic space 221, the wire 23 is for connecting a power source with the electromagnetic coil 22, and the driving member 24 is movably disposed within the electromagnetic space 221; when the wire 23 conducts electricity to the electromagnetic coil 22, the electromagnetic coil 22 produces a magnetic field within the electromagnetic space 221 to drive the driving member 24 to move along the direction lateral to the open direction of the outlet opening 12, and the driving member 24 drives the steering mechanism 3 to operate and bias the impacting member 5 to move toward the outlet opening 12.

More specifically, the steering mechanism 3 includes a first pushing member 31, a steering member 32 and a second pushing member 33, the first pushing member 31 is co-movably connected to the driving member 24, the second pushing member 33 is co-movably connected to the impacting member 5, the steering member 32 is rotatably attached to the main body 1, and two sides of the steering member 32 are respectively co-movably connected to the first pushing member 31 and the second pushing member 33. The steering member 32 is used to change a direction of the driving member 24 producing a force to a direction toward the outlet opening 12, and a transmission direction of the force changes from originally lateral to the open direction of the outlet opening 12 to toward the open direction of the outlet opening 12.

In the first embodiment, the driving member 24 is cylindrical, the driving member 24 abuts against the first pushing member 31, and a part of the first pushing member 31 is inserted into the driving member 24 to be in a linkage relation. The impacting member 5 is locked on the second pushing member 33, the impacting member 5 has an engaging hole 51, and a hook portion 333 of the second pushing member 33 is disposed through the engaging hole 51 to restrict the impacting member 5 so as to ensure that the impacting member 5 can stably resist greater impact.

Specifically, the steering member 32 is engaged with the first pushing member 31 and the second pushing member 33 through meshing, the steering member 32 includes a center of rotation 321, a first mesh portion 322 and a second mesh portion 323, the first mesh portion 322 is meshed with the first pushing member 31, and the second mesh portion 323 is meshed with the second pushing member 33. More specifically, the first pushing member 31 includes a first main body 311 and a first toothed row 312 which are connected to each other, the second pushing member 33 includes a second main body 331 and a second toothed row 332 which are connected to each other, the first toothed row 312 extends along the direction lateral to the open direction of the outlet opening 12, the second toothed row 332 extends along the open direction of the outlet opening 12, the first mesh portion 322 is meshed with the first toothed row 312, the second mesh portion 323 is meshed with the second toothed row 332, the first main body 311 and the driving member 24 are coaxially arranged, the first main body 311 and the center of rotation 321 of the steering member 32 are eccentrically arranged, and the impacting member 5 is attached to the second toothed row 332.

In the first embodiment, a distance between the first mesh portion 322 and the center of rotation 321 is greater than a distance between the second mesh portion 323 and the center of rotation 321, according to the formulas of torque and moment arm, the greater the distance between the first mesh portion 322 and the center of rotation 321, the longer the moment arm, so when the driving member 24 moves and biases the steering member 32 to rotate, the torque produced can be greater; and the smaller the distance between the second mesh portion 323 and the center of rotation 321, the shorter the moment arm, so under the circumstance that the torque is the same, the impacting member 5 can produce a greater force to impact. Shortly, the steering mechanism 3 can not only change the direction of force but also enhance force. In other words, the driving member 24 only needs to move within a small distance, the impacting member 5 can produce a great force, and the impacting member 5 can strike more quickly. Of course, in other embodiments, the cooperating distances and lengths could be different.

In the first embodiment, take a position of the outlet opening 12 as datum, a position of the center of rotation 321 is relatively lower than an axis of the driving member 24 and the first main body 311, a shortest vertical distance between the axis of the driving member 24 and the first main body 311 and the center of rotation 321 is defined as a first distance 81, a greatest distance between the first mesh portion 322 and the center of rotation 321 is defined as a second distance 82, and a greatest distance between the second mesh portion 323 and the center of rotation 321 is defined as a third distance 83. After many actual tests, the striking effect would be better when a ratio of the first and second distances 81, 82 is between 0.2 and 0.4, and a ratio of the second and third distances 82, 83 is between 1.2 and 1.7.

Preferably, the electric striking device further includes two buffering bodies 6, the two buffering bodies 6 are disposed on the main body 1 on the direction lateral to the opening direction of the outlet opening 12 and have a predetermined distance therebetween, the two buffering bodies 6 and the driving member 24 interfering with each other, the two buffering bodies 6 restrict the driving member 24 to move only within the predetermined distance, and the two buffering bodies 6 can absorb an impact produced when the driving member 24 moves, decrease shakes so that the user can stably grip the electric striking device and operate. The two buffering bodies 6 are made of rubber, and the two buffering bodies may also be made of other materials, for example but not limited thereto, foam, PVC, EVA and other impact-absorbing materials.

More preferably, the striking unit 2 further includes a first return spring 41, one of two ends of the first return spring 41 is abutted on the main body 1, the other of two ends of the first return spring 41 is connected to one of the impacting member 5 and the second pushing member 33, and when the electromagnetic device 21 is not actuated, the first return spring 41 can return the driving member 24, the steering mechanism 3 and the impacting member 5 to their initial positions to prepare for next movement. In the first embodiment, the other of two ends of the first return spring 41 is connected to the second pushing member 33, more specifically, the other of two ends of the first return spring 41 abuts against the second main body 331, and an extension direction of the first return spring 41 is oblique to the open direction of the outlet opening 12.

Figure 7:
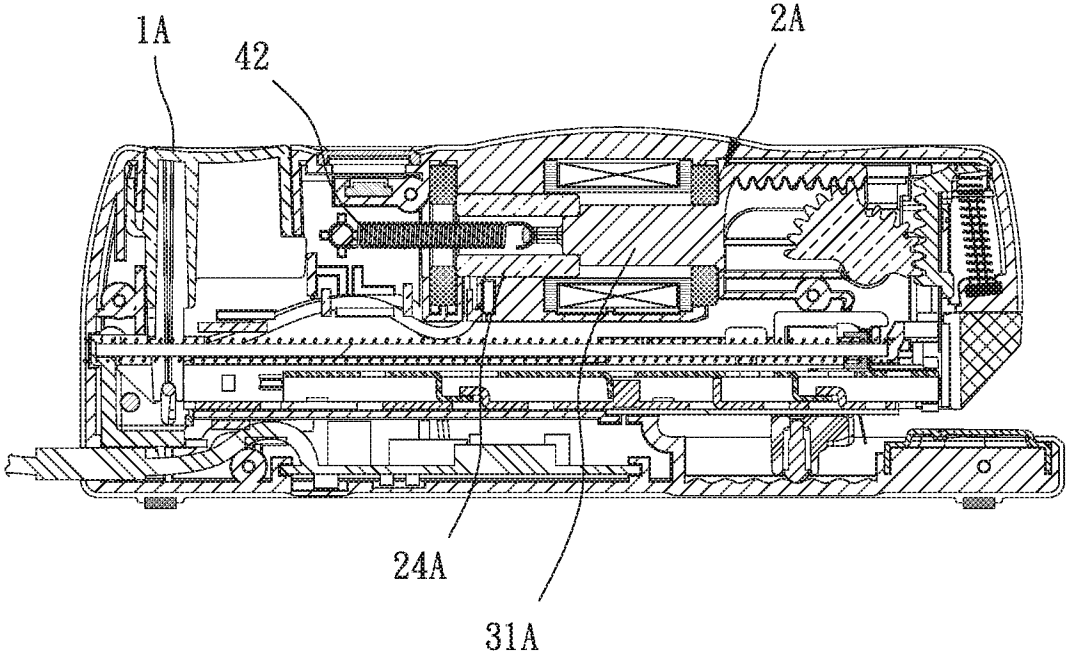
FIG. 7 is a cross-sectional view of a second embodiment of the present invention.

Please also refer to FIG. 7 for the striking unit 2A of a second embodiment. The striking unit 2A further includes a second return spring 42, one of two ends of the second return spring 42 is abutted on the main body 1A, and the other of two ends of the second return spring 42 is connected to one of the driving member 24A and the first pushing member 31A to pull the driving member 24A back to its initial position. In the second embodiment of FIG. 7, the other of two ends of the second return spring 42 is directly connected to the driving member 24A, according to different requirements, the striking unit may only include the first return spring 41 or the second return spring 42, and of course, the first return spring 41 can cooperate with the second return spring 42 to be used together.

Please further refer to FIGS. 1 to 6 for the first embodiment, the electric striking device further includes an anvil sheet 71 and a nail magazine assembly 72, it is understandable that the outlet opening 12 is located between the anvil sheet 71 and the impacting member 5, and the nail magazine assembly 72 is for carrying a plurality of nails and located between the outlet opening 12 and the impacting member 5. When the electromagnetic device 21 is actuated, the impacting member 5 moves toward the anvil sheet 71 to strike a nail from the outlet opening 12, and the anvil sheet 71 is for blocking the nail which is struck.

In addition, the steering mechanism 3 may be in modes other than the modes mentioned above in accordance with different requirements.

Figure 8:
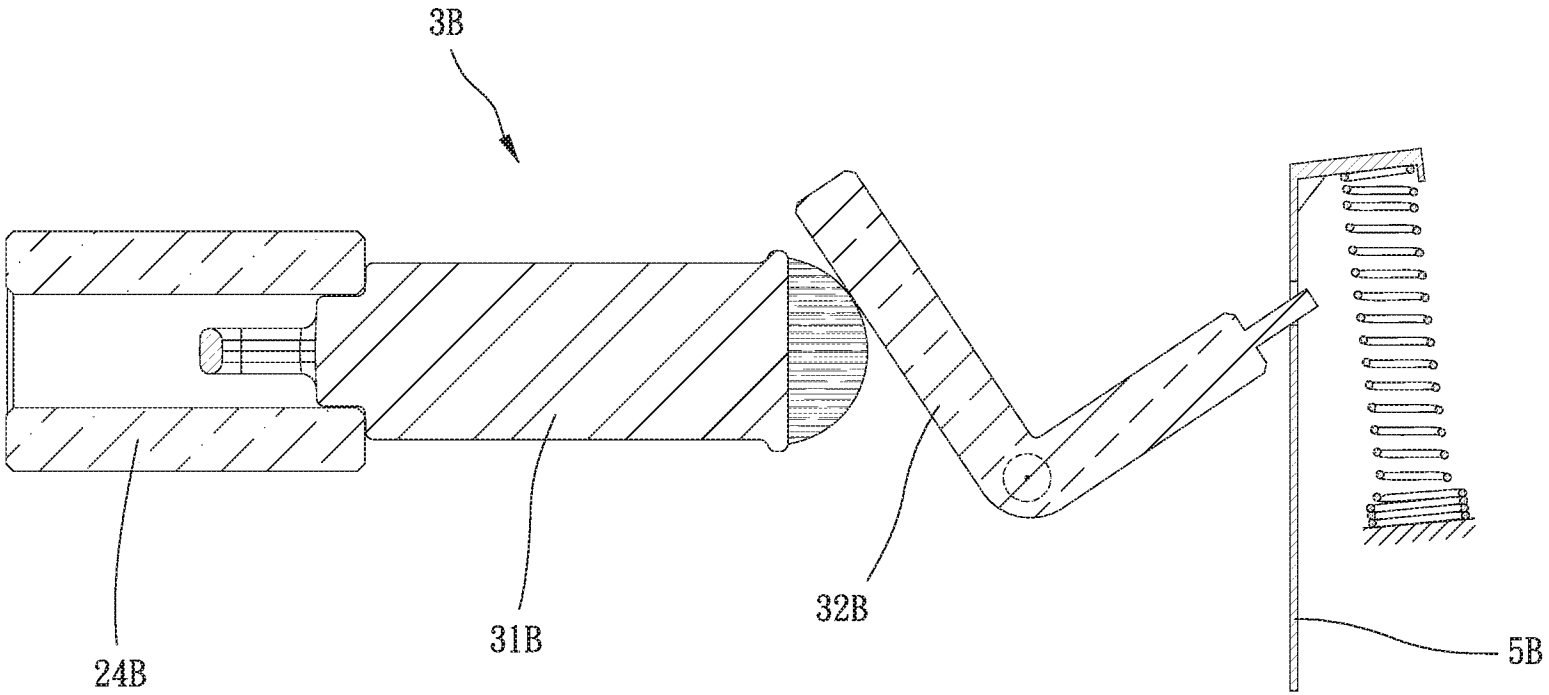
FIG. 8 is a drawing showing the steering mechanism of a third embodiment of the present invention in operation.

For example but not limited thereto, in a third embodiment of FIG. 8, the steering mechanism 3B includes a first pushing member 31B and a steering member 32B, the first pushing member 31B is co-movably connected to the driving member 24B, and the steering member 32B is rotatably attached to the main body 1 (please refer to FIG. 1) and co-movably connected to the impacting member 5B; when the driving member 24B is driven by the magnetic field to move, the first pushing member 31B pushes the steering member 32B to rotate to actuate the impacting member 5B to strike. A front end of the first pushing member 31B may be provided with a buffering portion, the buffering portion is used to contact the steering member 32B, to absorb the impact produced when the first pushing member 31B impacts and pushes the steering member 32B and further to maintain a structure integrity of the first pushing member 31B and the steering member 32B.

Given the above, in the electric striking device, the steering mechanism changes the direction of the force which laterally moves the driving member to function toward the outlet opening so as to fully and effectively use the existing space in the main body, so the electric striking device has a compact space and is easy to be stored and gripped. In addition, in the steering member of the steering mechanism, the distance between the first mesh portion and the center of rotation and the distance between the second mesh portion and the center of rotation are different, so based on the principle of torque and moment arm, the impacting member can produce a greater impact force to strike the nail or strike the nail with a faster speed.

While we have shown and described various embodiments in accordance with the present invention, it should be clear to those skilled in the art that further embodiments may be made without departing from the scope of the present invention.

What is claimed is:

1. An electric striking device, including:

a main body, including an interior space and an outlet opening;

a striking unit, disposed in the interior space, including an electromagnetic device, a driving member, a steering mechanism and an impacting member, the electromagnetic device being actuated by electricity to produce a magnetism to drive the driving member to move along a direction lateral to an open direction of the outlet opening, the open direction of the outlet opening being the same as the direction of operation of the impacting member, the impacting member being on the open direction of the outlet opening and movable along the open direction of the outlet opening, the driving member and the impacting member being respectively connected to the steering mechanism;

wherein the steering mechanism includes a first pushing member, a steering member and a second pushing member, the first pushing member is co-movably connected to the driving member, the second pushing member is co-movably connected to the impacting member, the steering member is rotatable attached to the main body, and two sides of the steering member are respectively co-movably connected to the first pushing member and the second pushing member; wherein the steering member includes a center of rotation, a first mesh portion and a second mesh portion, the first mesh portion is meshed with the first pushing member, and the second mesh portion is meshed with the second pushing member;

wherein the first pushing member includes a first main body and a first toothed row which are connected to each other, the second pushing member includes a second main body and a second toothed row which are connected to each other, the first toothed row extends along the direction lateral to the open direction of the outlet opening, the second toothed row extends along the open direction of the outlet opening, the first mesh portion is meshed with the first toothed row, and the second mesh portion is meshed with the second toothed row; the first main body and the driving member are coaxially arranged, the first main body and the center of rotation of second toothed row.

2. The electric striking device of claim 1, wherein the electromagnetic device includes an electromagnetic coil and a wire, the driving member is an iron core, the electromagnetic coil defines an electromagnetic space, the wire is for connecting a power source with the electromagnetic coil, and the driving member is movably disposed within the electromagnetic space; when the wire conducts electricity to the electromagnetic coil, the electromagnetic coil produces a magnetic field within the electromagnetic space to drive the driving member to move along the direction lateral to the open direction of the outlet opening, and the driving member drives the steering mechanism to operate and bias the impacting member to move toward the outlet opening.

3. The electric striking device of claim 1, wherein the striking unit further includes a first return spring, one of two ends of the first return spring is abutted on the main body, and the other of two ends of the first return spring is connected to one of the impacting member and the second pushing member.

4. The electric striking device of claim 1, wherein the striking unit further includes a second return spring, one of two ends of the second return spring is abutted on the main body, and the other of two ends of the second return spring is connected to one of the driving member and the first pushing member.

5. The electric striking device of claim 1, wherein the steering member is co-movably connected to the impacting member; when the driving member is driven by the magnetism to move, the first pushing member pushes the steering member to rotate to actuate the impacting member to strike.

6. The electric striking device of claim 1, further including two buffering bodies, the two buffering bodies disposed on the main body on the direction lateral to the open direction of the outlet opening and having a predetermined distance therebetween, the two buffering bodies and the driving member interfering with each other, the two buffering bodies restricting the driving member to move only within the predetermined distance.

7. The electric striking device of claim 1, wherein the electromagnetic device includes an electromagnetic coil and a wire, the driving member is an iron core, the electromagnetic coil defines an electromagnetic space, the wire is for connecting a power source with the electromagnetic coil, and the driving member is movably disposed within the electromagnetic space; when the wire conducts electricity to the electromagnetic coil, the electromagnetic coil produces a magnetic field within the electromagnetic space to drive the driving member to move along the direction lateral to the open direction of the outlet opening, and the driving member drives the steering mechanism to operate and bias the impacting member to move toward the outlet opening; a distance between the first mesh portion and the center of rotation is greater than a distance between the second mesh portion and the center of rotation; the striking unit further includes a first return spring, one of two ends of the first return spring is abutted on the main body, and the other of two ends of the first return spring is connected to the second pushing member; the electric striking device further includes two buffering bodies, the two buffering bodies are disposed on the main body on the direction lateral to the open direction of the outlet opening and have a predetermined distance therebetween, the two buffering bodies and the driving member interfere with each other, and the two buffering bodies restrict the driving member to move only within the predetermined distance; the electric striking device further includes an anvil sheet and a nail magazine assembly, the outlet opening is located between the anvil sheet and the impacting member, and the nail magazine assembly is for carrying a plurality of nails and located between the outlet opening and the impacting member; when the electromagnetic device is actuated, the impacting member moves toward the anvil sheet to strike a nail from the outlet opening, and the anvil sheet is for blocking the nail which is struck; take a position of the outlet opening as datum, a position of the center of rotation is relatively lower than an axis of the driving member and the first main body, a shortest vertical distance between the axis of the driving member and the first main body and the center of rotation is defined as a first distance, a greatest distance between the first mesh portion and the center of rotation is defined as a second distance, a greatest distance between the second mesh portion and the center of rotation is defined as a third distance, a ratio of the first and second distances is between 0.2 and 0.4, and a ratio of the second and third distances is between 1.2 and 1.7; the other of two ends of the first return spring abuts against the second main body, and an extension direction of the first return spring is oblique to the open direction of the outlet opening; the impacting member is locked on the second pushing member, the impacting member has an engaging hole, and a hook portion of the second pushing member is disposed through the engaging hole to restrict the impacting member; the two buffering bodies are made of rubber; the driving member is cylindrical, the driving member abuts against the first pushing member, and a part of the first pushing member is inserted into the driving member.

* * * * *